US005082291A

United States Patent [19]

Appel et al.

[11] Patent Number: 5,082,291

[45] Date of Patent: Jan. 21, 1992

[54] PROJECTILE AND TARGET GAME APPARATUS

[75] Inventors: Mel Appel, Livingston, N.J.; Denni Rivette, Akron, Ohio

[73] Assignee: Mel Appel Ltd., Kowloon, Hong Kong

[21] Appl. No.: 721,327

[22] Filed: Jun. 27, 1991

[51] Int. Cl.[5] ..... A63B 67/00

[52] U.S. Cl. ..... 273/346; 273/412; 273/DIG. 17; 273/DIG. 30

[58] Field of Search ..... 273/346, 412, 58 K, 273/DIG. 17, DIG. 30

[56] References Cited

U.S. PATENT DOCUMENTS

| | | | |
|---|---|---|---|
| 3,341,201 | 9/1967 | Ryan | 273/DIG. 17 X |
| 3,628,794 | 12/1971 | Conture | 273/337 |
| 3,917,271 | 11/1975 | Lemelson et al. | 273/346 |
| 3,927,881 | 12/1975 | Lemelson et al. | 273/346 X |
| 3,941,383 | 3/1976 | Clarke | 273/346 |
| 3,953,030 | 4/1976 | Muchnick | 273/346 |
| 3,999,748 | 12/1976 | Clarke | 273/346 |
| 4,017,076 | 4/1977 | Bai | 273/346 |
| 4,029,316 | 6/1977 | Clarke | 273/346 X |
| 4,240,639 | 12/1980 | Bolton et al. | 273/346 |
| 4,718,677 | 1/1988 | Barnes | 273/346 X |
| 4,825,886 | 5/1989 | Allen | 132/54 |
| 4,971,334 | 11/1990 | Stewart | 273/346 |
| 4,986,548 | 1/1991 | Conner | 273/346 |
| 4,995,617 | 2/1991 | Lee | 273/346 |

*Primary Examiner*—William H. Grieb
*Attorney, Agent, or Firm*—Amster, Rothstein & Ebenstein

[57] ABSTRACT

Apparatus for a projectile-target game includes at least one projectile and at least one cap. The projectile is soft, lightweight and resilient and has an outer surface consisting essentially of a felt-like material suitable for releasably bonding with a hook-like material. The cap is configured and dimensioned to be releasably worn on and about the head of a player of the game, the cap when worn having an exposed outer surface defining at least one target area including at least one region of a hook-like material suitable for releasably bonding with the felt-like material of the projectile.

11 Claims, 1 Drawing Sheet

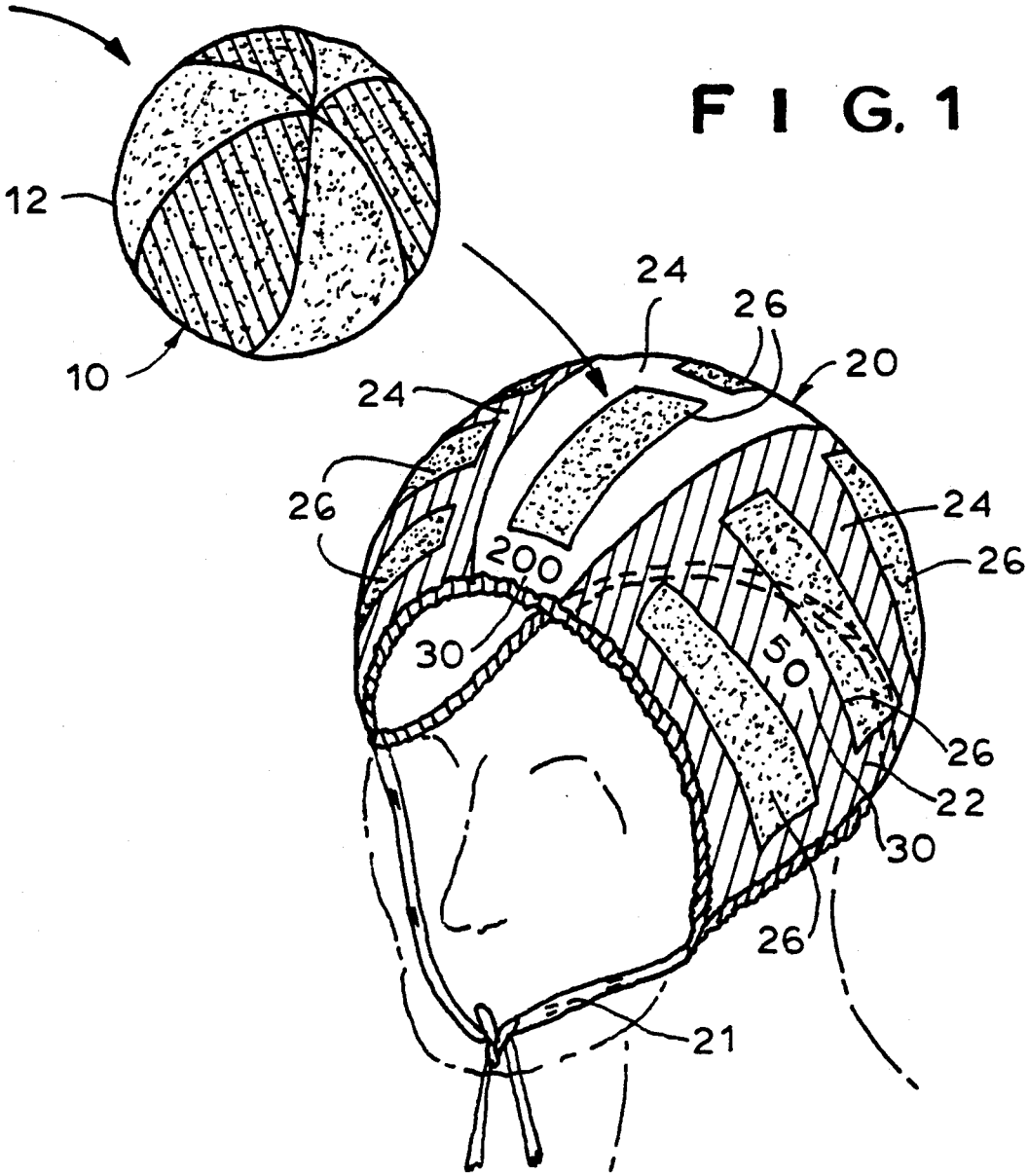
FIG. 1
FIG. 2
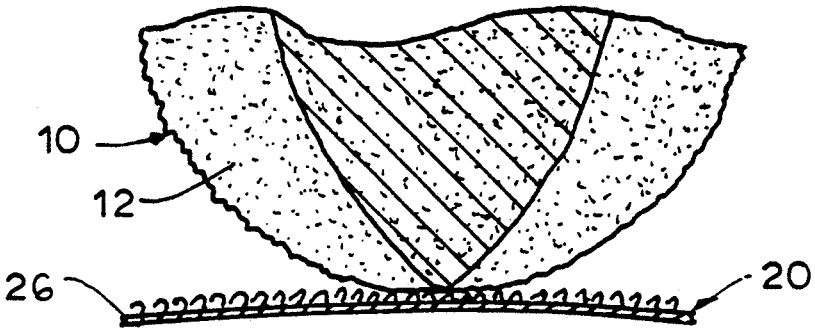

PROJECTILE AND TARGET GAME APPARATUS

BACKGROUND OF THE INVENTION

The present invention relates to apparatus for use in projectile and target game, and more particularly to such apparatus using VELCRO as a binding agent.

Throw-and-catch games wherein the player attempts to catch a thrown projectile and throw-and-avoid games wherein a player attempts to avoid being hit by a thrown projectile are both well known in the game art. The phrase "projectile-target game" as used herein encompasses both the throw-and-catch and throw-and-avoid games, the primary difference being the two being whether or not the target-wearer is going to catch or avoid the thrown projectile.

While conventionally the "catch" of a thrown projectile was done with a mitt worn on a player's hand and required that the mitt be manipulated in such a manner as to retain the caught projectile within the mitt, more recently the thrown projectile and the catching surface include VELCRO materials which releasably bond or secure to one another upon contact so that no action on the part of the catcher is required other than to ensure that the target area is in the appropriate place at the appropriate time to be contacted by the projectile. As a result, in addition to mitt games wherein the target area is disposed on a mitt or glove (see U.S. Pat. No. 4,995,617), target areas are now also disposed on elbow or knee pads (see U.S. Pat. No. 4,718,677) or on chest or back pads (see U.S. Pat. No. 4,971,334 and U.S. Pat. No. 4,986,548). Each of the aforementioned patents utilizes a VELCRO or like material consisting of a first strip of a felt-like material having a plurality of exposed closed miniloops (miniature loops) and a second strip having a plurality of hook-like miniprojections (miniature projections) adapted to engage and releasably retain the miniloops of the felt-like material.

The games described in the aforementioned patents have not proven to be entirely satisfactory in use. In particular instances, the relatively stiff and rough hook-like material was disposed on the projectile so that the impact of the projectile on the bare skin of a player was uncomfortable and could abrade the skin. Indeed, if the projectile was small enough, it could enter the eye socket and possibly damage an eye or enter the mouth and possibly become swallowed. In yet other instances, because the target area was disposed on the knees, elbows, chest, back, hands or the like, it was relatively easy for a player to protect the target area from his opponent (for example, by hiding the target area behind an obstruction or by assuming a position which concealed the target area from his opponent) while still being able to launch projectiles of his own against the opponent.

Accordingly, it is an object of the present invention to provide a projectile-target game apparatus in which the projectile is sufficiently soft, lightweight and large to prevent accidental injury to a player hit thereby.

Another object is to provide such apparatus wherein the target area is disposed on a player in a location such that he cannot easily conceal the same from his opponent while he is throwing projectiles of his own.

A further object is to provide such apparatus wherein the target area is disposed on a player's head such that he can attempt to catch the projectile by appropriate positioning of his body and head.

It is also an object of the present invention to provide such apparatus which simple, easy and economical to manufacture, use and maintain.

SUMMARY OF THE INVENTION

It has now been found that the above and related objects of the present invention are obtained in apparatus for a projectile-target game comprising a projectile and a cap. The projectile is soft, lightweight and resilient and has an outer surface consisting essentially of a felt-like material suitable for releasably bonding with a hook-like material. Preferably the projectile is operatively seemless, devoid of projections, and at least two inches in diameter. The cap is configured and dimensioned to be releasably worn on and about the head of a player of the game, the cap when worn having an exposed outer surface defining at least one target area including at least one region of a hook-like material suitable for releasably bonding with the felt-like material of the projectile.

In a preferred embodiment of the invention, the exposed outer surface of the cap defines a plurality of the target areas, each of the target areas being visually distinguishable from an adjacent one of the target areas, including at least one of the regions of hook-like material, and having a different score or target value assigned thereto than to the adjacent target areas (and perferably all other target areas). Preferably, the exposed outer surface of the cap additionally includes scoring indicia in each of the target areas for indicating the score to be awarded upon releasable bonding of the projectile to one of the regions in the target area.

Typically, when the cap is worn it covers a large surfaces (and preferably a major portion) of the player's head about the face thereof. The regions of hook-like material extend along generally longitudinal and latitudinal lines of the head of the player.

BRIEF DESCRIPTION OF THE DRAWING

The above and related objects, features and advantages of the present invention will be more fully understood by reference to the following detailed description of the presently preferred, albeit illustrative, embodiments of the present invention when taken in conjunction with the accompanying drawing wherein:

FIG. 1 is a fragmentary isometric view of a player utilizing apparatus according to the present invention; and FIG. 2 is a fragmentary elevational view, to an enlarged scale and partially in cross section, illustrating the bonding of a projectile to a cap.

DETAILED DESCRIPTION OF THE PREFERRED EMBODIMENTS

Referring now to the drawing, FIG. 1 illustrates apparatus for a projectile-target game according to the present invention, as it might be used during play of the game. The projectile-target game may be of either the throw-and-catch or throw-and-avoid variety and may involve either one player alone or a plurality of players (who may play individually or in teams).

The apparatus consists basically of one or more projectiles generally designated by the reference numeral 10 and one or more caps generally designated 20.

The projectile 10 is soft, lightweight, and preferably operatively seamless and devoid of projections, so that—regardless of the force with which it is thrown—it is unlikely to do any damage to normal skin. Further, the projectile is preferably at least two inches in diameter, optimally at least three inches in diameter, so that it cannot either accidentally or intentionally enter the eyes, mouth, ears or nostrils of a player. The projectile is also resilient so as to substantially resume its original configuration after any deformation either during throwing or impact.

The total exposed outer surface 12 of the projectile 10 consists essentially of a felt-like material (with a plurality of closed miniloops) suitable for releasably bonding with a hook-like material, and may specifically be a VELCRO pad adapted to releasably bond with VELCRO hook-like material. The term "felt-like" is intended to mean any soft fabric which has the capacity to firmly but releasably become attached to hook-like material such as hook-like VELCRO. The felt-like material has a soft, fuzzy feel and is devoid of sharp edges and projections so that it presents a user-friendly outer surface. The projectile may conveniently be formed of a soft, lightweight sponge or expanded foam core overwrapped with a covering of the felt-like material in such a manner that preferably the seams are hidden. The core is preferably composed of many expanded foam parts made of polyurethane. The outer surface 12 may be of a single color or patterned with different colors to present a more interesting appearances or to add further scoring factors, as indicated by the shading (which here represents color rather sectioning).

The cap 20 is configured and dimensioned to be releasably worn on and about the head (illustrated in phantom line) of a player of the game. The cap 20 may be elastic or, as illustrated, provided with chin straps 21 for securing the cap 20 about the player's head by tying the chin straps 21 below the chin. When worn, the cap 20 covers a large surface (and preferably a major portion) of the player's head about the face thereof. The cap 20 when worn has an exposed outer surface 22 defining at least one target area 24. Each target area 24 in turn includes at least one region 26 of a hook-like material which is suitable for releasably bonding with the felt-like material of the projectile outer surface 12 (as illustrated in FIG. 2) and which may specifically be VELCRO hook-like material having a plurality of mini-projections. Preferably, as illustrated, the exposed outer surface 22 of the cap 20 defines a plurality of the target areas 24, each of the target areas 24 being visually distinguishable from an adjacent one of the target areas 24, for example, by color (here represented by shading), or the like. Each of the target areas 24 includes at least one region 26 of the hook-like material.

Preferably the cap outer surface 22 additionally includes scoring indicia 30 (e.g., "50", "200", etc.) in each of the target areas 24 for indicating the score or target value to be awarded upon releasable bonding of the projectile 10 to one of the regions 26 in that target area 24. The score assigned to each of the target areas 24 preferably differs from the score assigned to adjacent target areas 24, and optimally all other target areas. Optionally, the scoring indicia 30 need not be disposed on the cap 20 itself, and the various scores or target values assigned to each target area 24 may be indicated in the instructions accompanying the apparatus—for example, each target area may be a different color and each color may have a particular score or target value assigned thereto. The provision of different scores or target values to various target areas increases the play value of the game.

The regions 26 of hook-like material on cap 20 preferably extend along generally longitudinal and latitudinal lines of the head of the player when the cap 20 is worn. As the cap 20 and its target areas 24 extends generally over the top of the wearer's head, as well as along the back, sides and upper front thereof, it is quite difficult for the player to throw a projectile at his opponent (except by means of a lob) without exposing at least some of his target areas 24 to the opponent. Similarly, the provision of target areas 24 over the major portions of the player's head provides the opportunity for the player to catch or capture a thrown projectile 10 by the exercise of skill and quick movement of his or her head and to vary the specific target areas 24 where attachment is made.

To summarize, the present invention provides a projectile-target game apparatus in which the projectile is sufficiently soft, lightweight and large to prevent an accidental injury to a player hit thereby on bare skin. Also the target area is disposed on a player's head such that he can attempt to catch the projectile by appropriate positioning of his body and head. Further, the target area is disposed on the player in a location such that he cannot easily conceal the same from his opponent while he is throwing projectiles of his own. Finally, the apparatus is simple, easy and economical to manufacture, use and maintain.

Now that the preferred embodiments of the present invention have been shown and described in detail, various modifications and improvements thereon will become readily apparent to those skilled in the art. Accordingly, the spirit and scope of the present invention is to be construed broadly and in a manner consistent with the appended claims, and not limited by the foregoing specification.

I claim:

1. Apparatus for a projectile-target game, comprising:

(A) a projectile which is soft, lightweight and resilient and has an outer surface consisting essentially of a felt-like material suitable for releasably bonding with a hook-like material; and (B) a cap configured and dimensioned to be releasably worn on and about the head of a player of the game, said cap when worn having an exposed outer surface defining at least one target area including at least one region of a hook-like material suitable for releasably bonding with said felt-like material of said projectile.

2. The apparatus of claim 1 wherein said exposed outer surface of said cap defines a plurality of said target areas, each of said target areas being visually distinguishable from an adjacent one of said target areas, including at least one of said regions of hook-like material, and having a different score or target value assigned thereto than to said adjacent target areas.

3. The apparatus of claim 2 wherein each of said target areas has a different score or target value assigned thereto than another of said target areas.

4. The apparatus of claim 2 wherein said exposed outer surface of said cap additionally includes scoring indicia in each of said target areas for indicating the score to be awarded upon releasable bonding of said projectile to one of said regions in said target area.

5. The apparatus of claim 1 wherein, when said cap is worn, said regions of hook-like material extend along generally longitudinal and latitudinal lines of the head of the player.

6. The apparatus of claim 1 wherein said projectile is operatively seemless, devoid of projections, and at least two inches in diameter.

7. The apparatus of claim 1 wherein said cap additionally includes means for securely attaching said cap to the player's head.

8. The apparatus of claim 1 wherein, when said cap is worn, it covers large surfaces of the player's head about the face thereof.

9. The apparatus of claim 1 wherein said cap is worn it covers a major portion of the player's head about the face thereof.

10. The apparatus of claim 1 wherein said hook-like and felt-like materials firmly but releasably bond together.

11. Apparatus for a projectile-target game, comprising:

(A) a projectile which is soft, lightweight and resilient, is operatively seemless, devoid of projections, and at least two inches in diameter, and has an outer surface consisting essentially of a felt-like material suitable for firmly but releasably bonding with a hook-like material; and (B) a cap configured and dimensioned to be releasably worn on and about the head of a player of the game and cover a major portion thereof about the face thereof, said cap when worn having an exposed outer surface defining a plurality of target areas, each of said target areas being visually distinguishable from an adjacent one of said target areas, including at least one region of hook-like material suitable for firmly but releasably bonding with said felt-like material of said projectile, and having scoring indicia for indicating the score to be awarded upon releasable bonding of said projectile to one of said regions in said target area, the indicated score being different than the score indicated on adjacent target areas.

* * * * *